US006217024B1

(12) United States Patent
Lofink et al.

(10) Patent No.: US 6,217,024 B1
(45) **Date of Patent: *Apr. 17, 2001**

(54) BLACKJACK GAME WITH MODIFIABLE VIGORISH

(75) Inventors: Kurt Lofink; Richard Lofink, both of Las Vegas, NV (US)

(73) Assignee: Masque Publishing, Inc., Englewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/802,005

(22) Filed: Feb. 18, 1997

Related U.S. Application Data

(63) Continuation-in-part of application No. 08/633,876, filed on Apr. 10, 1996, now Pat. No. 5,615,888.
(60) Provisional application No. 60/002,991, filed on Aug. 28, 1995.

(51) Int. Cl.[7] ..... A63F 1/00
(52) U.S. Cl. ..... 273/292
(58) Field of Search ..... 273/292, 274, 273/309; 463/12, 13

(56) References Cited

U.S. PATENT DOCUMENTS 5,098,107 * 3/1992 Boylan et al. ..... 273/292
5,275,415 * 1/1994 Wisted ..... 273/274
5,549,300 * 8/1996 Sardarian ..... 273/292
5,615,888 * 4/1997 Lofink et al. ..... 273/292

OTHER PUBLICATIONS

Winning Gamer newsletter, Pi Yee Press, La Jolla, CA, Feb. 1985.*

21st Century Blackjack, Casino Gaming Concepts, Inc., Irvine, CA, 1994.*

* cited by examiner

*Primary Examiner*—Benjamin H. Layno
(74) *Attorney, Agent, or Firm*—Sheridan Ross P.C.

(57) ABSTRACT

A method for providing a modified game of Twenty-One is provided which includes removing player favorable cards from or adding player unfavorable cards to relative to a standard fifty-two card deck. To adjust the house advantage or vigorish as a result of the modification of the deck, the method of play is modified to provide one or more liberal game rules and bonus payouts on the player's hand. The combination of rules changes and deck modification can be used to approximately obtain a selected vigorish. Further the method of playing the game makes card counting much more difficult for the professional card player. Preferably multiple decks, up to six decks, of these modified decks are used.

21 Claims, No Drawings

BLACKJACK GAME WITH MODIFIABLE VIGORISH

CROSS-REFERENCE TO RELATED APPLICATION

This application is a Continuation-in-Part of application Ser. No. 08/633,876 filed Apr. 10, 1996 is now U.S. Pat No. 5,615,888 which is a continuation-in-part application of provisional application Ser. No. 60/002,991, filed Aug. 28, 1995, entitled "Spanish Twenty-One Card Game."

FIELD OF THE INVENTION

This invention relates to a card game, and more particularly to a card game based on Twenty-One but using one or more modified decks of playing cards and modified rules complimentary to said modified decks to obtain a predeterminable vigorish for the game.

BACKGROUND OF THE INVENTION

Conventional Twenty-One involves a game of chance between a dealer and one or more players using one or more standard decks having fifty-two playing cards. The object is for the player to achieve a count of his hand closer to 21 than the count of the hand of the dealer; but if the count of the player's hand goes over 21 then the player loses regardless of the final count of the dealer's hand.

The manner of play of Twenty-One according to the standard and well known rules therefor is as follows: A standard deck of fifty-two playing cards is used and each card counts its face value, except Aces which have a value of one or eleven as is most beneficial to the count of the hand and face cards, i.e. Kings, Queens and Jacks, have a count of ten. After making a wager, each player initially receives two cards. The dealer also receives two cards. One of the dealer's cards is dealt face down and the other of the dealer's cards is dealt face-up. In some gaming establishments, the dealer receives his two cards at the same time that each player is dealt his two cards. In other gaming establishments, the dealer initially only receives one card which becomes the dealer's "up" card. After each player has taken additional cards, the dealer then receives his second card.

A player may draw additional cards (take "hits") in order to try and beat the count of the dealer's hand. If the player's count exceeds 21, the player "busts." The player may "stand" on any count of 21 or less. When a player busts, he loses his wager regardless of whether or not the dealer busts.

After all of the players have taken hits or have stood on their hand, the dealer "stands" or "hits" based on pre-established rules for the game. Typically, if the dealer has less than 17, the dealer must take a hit. If the dealer has 17 or more, the dealer stands.

As the game of Twenty-One is played in most legalized gaming establishments, the conventional manner of play requires the dealer to take a hit whenever the dealer's hand is a "soft 17" count. However in other gaming establishments, the dealer stands on a "soft 17" count. The term "soft" means that the Ace is valued as a count of 11, instead of as a count of 1. A soft 17 occurs when the dealer has an Ace and a Six (or multiple cards that add up to 6). The dealer will stand on soft 18's, soft 19's and soft 20's.

After the dealer's final hand has been established, the numerical count of the dealer's hand is compared to the numerical count of the player's hand. If the dealer busts (his numerical hand count exceeds 21), the player wins regardless of the numerical count of the player's hand. If neither the player nor the dealer has busted, the closest hand to a numerical count of 21, without going over, wins; tie hands are a "push."

Other rules are provided for the play of standard Twenty-One. One well-known rule relates to "Doubling Down." If the player's first two cards have a combined value of 10 or 11, the player may "double down" on his hand. The player turns both of his cards face-up in front of him and makes a second wager equal to the amount of his initial ante. The dealer deals to the player one additional card and the resulting three card hand establishes the numerical count for the player's hand. The most widely used "Doubling Down" rules permit the player to "double down" only on initial two card 10 or 11 counts. Other variations allow players to "double down" on 9, 10 or 11; only on 11; or on any two cards.

Another well-known rule for standard Twenty-One is "Splitting Pairs." If the player's first two cards are a pair, the player may "split" those cards into two separate hands. His original ante is applied to one of the hands and he makes an additional ante for the other hand. The player receives a new second card for each of the split hands. Each of the split hands is played separately and the player proceeds by standing or taking hits until he has achieved a hand count upon which he wishes to stand or busts. However, if a player has split a pair of Aces, the player only receives one new card on each Ace; unless the new card is another Ace, in which case the player may again split the Aces and receive one new card on each Ace. Most establishments limit the number of splits particularly of Ace pairs. Often Aces can only be split once.

The player may "double down" on either or both of his split hands if he is eligible to do so under the "Doubling Down" rules. The player may split again if he pairs up on either or both of his split hands with certain restrictions referred to above. In most gaming establishments, a player may also split his hand if both of his initial cards are ten count cards (Tens, Jacks, Queens or Kings). For example, a player can split if he receives a Ten and a Queen, or a Jack and a King, or any combination of ten count cards. Because a hand count of 20 is a good hand to have, most experienced Twenty-One players are reluctant to risk such a hand by "splitting".

Another well-known rule for standard Twenty-One relates to "Insurance." If the dealer's up card is an Ace, the player may make an additional "insurance" bet. The insurance bets are made after each player receives his first two cards and the dealer reveals his up card and before any additional cards are dealt. When the dealer's up card is an Ace, each player can wager one-half of the amount of his original ante as insurance against the dealer having a Blackjack, i.e. a two-card 21 count (an Ace and a 10 count card such as a King, Queen, Jack or Ten). If the dealer has a two-card 21 count, the player loses on his original ante but wins two-to-one odds on his second "insurance" bet. Also if the dealer has a two-card 21 count, that round of the game is over, players may not draw additional cards and all players lose except those who also have two-card 21 counts who tie or "push" with the dealer. If the dealer does not have a two-card 21 count, the player loses on his "insurance" bet and the round of the game continues.

A further standard rule of Twenty-One which has been used is surrender. When the player's turn to stand, take a hit or otherwise take action arrives, some establishments allow the player to surrender, i.e. concede his hand, by announcing that he is surrendering and forfeiting half of his wager. If the dealer has an Ace or a ten-count card as the up card and upon checking the down card has a Blackjack, surrender is not available to a player since the hand is over without further player action.

As used in this disclosure and the accompanying claims, the terms "conventional" or "standard Twenty-one" and "the conventional manner of play of Twenty-One" mean the game of Twenty-One as previously described and also including any of the known variations of the game of Twenty-one.

Further standard or conventional Twenty-One has rules regarding payoffs for winning hands. Blackjack winning hands are paid at 3:2. All other winning hands are paid at even money. Again, if the player and dealer both have Blackjack, the hand is a push. Further if the player has a non-Blackjack 21 and the dealer has a Blackjack, the player loses. These payoffs along with the insurance payoff are the only payoffs in conventional Twenty-One.

Twenty-One has remained remarkably unchanged over the years. There have been a few other modifications proposed to the basic game, but none of these modifications have achieved universal popularity. For example, in the conventional manner of play of a Twenty-One game, the dealer shows one (the "up" card) of his first two cards and the other card (the "hole" card) is kept hidden until all the players have drawn to their hands. One modification involves the dealer showing both of his cards face-up before the players draw. This improves the player's odds of winning and the payout odds have been modified to adjust for this change so that the houses's adavantage remains.

Because of the known composition of the deck and the payoffs in Blackjack, a vigorish or profit to the casino can be calculated or empirically determined. In so calculating the vigorish it is presumed that the player will play perfectly, i.e. will not make mistakes. The vigorish for conventional Twenty-One under the rules therefor is approximately one percent. This low vigorish has contributed to the popularity of Twenty-One.

A further feature of conventional Twenty-one is that some knowledgeable players have the ability to count cards as they are dealt to determine when the composition of the remainder of the deck to be dealt is in their favor. If it can be determined when the deck becomes "positive" in favor of the player, the player can increase his wager and beat the game. The ability of the players to count is contributed to by the known, simple payoff schedule for the game and of course the known composition of the deck.

There is a need for a modified method of play of conventional Twenty-One which restores some of the fun and excitement to the game by using liberal payouts and play options that are normally not available under the conventional manner of play of Twenty-One. There is also a need for a game which is not susceptible to counters. Further there is a need for providing a game having these features which can be modified to adjust the vigorish for the game. The method of play of the present invention provides for modification of the card decks, complimentary rules of play, winning hands and payoffs which maintains a predetermined house advantage (vigorish) on the order of the house advantage enjoyed in conventional Twenty-One if desired and, at the same time, the method of play is unfavorable to professional card players who using card counting methods to tip the advantage of the game to their favor.

All of these goals are achieved by either or both the addition or elimination of player unfavorable or unfavorable cards to the cards dealt and a complementary modification of the rules of play including providing a payoff schedule which provides for additional payoffs to certain player hands. In one embodiment of the game as described in our co-pending application Ser. No. 08/633,876 entitled SPANISH TWENTY-ONE CARD GAME AND METHOD OF PLAY this modification is embodied by elimination of four player favorable cards (ten-count cards) from each conventional 52 card deck of playing cards. The elimination of the four ten-count cards makes card counting much more difficult for the professional card player.

The elimination of the player favorable ten-count cards also tips the vigorish of the game quite noticeably toward the house. To offset this change in the odds, the method of play is modified to provide liberal game rules and bonus payouts on the original hand which adjusts the vigorish to that of conventional Twenty-One. The result of these modifications to the method of play results in a player receiving some form of an advantage approximately once every eight hands of play.

In the preferred embodiment of the present invention, depending upon the alteration of the deck and the desired vigorish for the game, these rule modifications can take the form of:

(i) paying all player Blackjacks (a two card combination equaling a numerical count of 21) at three-to-two odds, including those occurring even if the dealer also has a Blackjack. Under the conventional manner of play of Twenty-One, the player's hand would be a push if both the player and the dealer had a Blackjack, (ii) paying the player's original bet at one-to-one odds if the player's hand has a numerical count of 21 even if the dealer also has a hand having a numerical count of 21. Under the conventional manner of play of Twenty-One, the player's hand would be a push if both the player and the dealer each had a hand having a numerical count of 21, (iii) allowing the player to double down on any two or more cards. Under the conventional manner of play of Twenty-One, the player may only double down on his first two cards (and some gaming establishments only allow doubling down if the first two cards have a numerical count of 10 or 11). This doubling down would be permitted even after the player has split pairs, up to a maximum of four hands, (iv) in certain situations, allowing the player to rescue his double down wager (known as "Double Down Rescue"). After effecting a double down and receiving the third card, a player who is dissatisfied with his non-busted hand may take back (or rescue) the doubled portion of his wager and forfeit his original wager and concede his hand. Alternatively, the player could be given the option of simply taking back (or rescuing) the doubled portion of his wager and continuing the play of the game. This double down rescue option is not available to the player if the third card causes the player's numerical hand count to exceed 21, (v) bonus payouts are added to the method of play. If the player achieves one of a pre-designated card combination(s) during the play of his hand, he receives the associated bonus payout based on a pre-established payout schedule, and (vi) providing for early surrender. Under standard rules of Twenty-One, if the dealer has an up card of an Ace, the dealer checks to see if any players want insurance. If the dealer upon checking has a Blackjack, the hand is over and all players not also having a Blackjack lose.

Early surrender enables players, prior to the dealer checking the down card, to surrender their hand and only lose half their wager.

(vii) re-doubling. Under a rule of re-doubling according to the present invention, when a player doubles down once, he may double down again by matching the amount he has at risk. For example, the dealer has a 5 showing and the player's first two cards are an Ace and a six for a soft seventeen. The player doubles down and receives a 3 for a total of 10 or 20. The player by matching the total of the wagers in action may double down again.

(viii) three card surrender. Under this modified rule a player may surrender after hitting his initial two card hand, now having three cards, and the hand does not exceed a numerical count of 21.

(ix) dealer Ace up exposure. Under this player favorable rule, if the dealer has an up card as an Ace, after allowing for an insurance bet to be made, the down card is turned over and exposed for the players to see. This action precedes the player's action. Hence the players know the dealers two card hand and can use this information in deciding to stand, take a hit or take further action. If the dealer has a Blackjack, all player hands are immediately resolved with no further player action.

The method of the present invention still includes playing the game according to the standard manner of play of Twenty-One with regard to Insurance wagers being allowed and the dealer hitting any hand that has a numerical count of a soft 17 or lower. Alternatively, the method can also include the conventional manner of play of Twenty-one in those gaming establishments that mandate that the dealer stand on soft 17 or higher. The conventional "Surrender" option is also available in which the player may reclaim half of his original wager by surrendering his hand when it is his turn for action on his hand. This may be combined with the early surrender described above.

The method of the present invention is seen to offer advantages to both the player and the house. The player will be receiving more entertainment value for his wager since rules are liberalized and players have the possibility of receiving bonus payouts up to three times the amount of his original wager. The player will also enjoy having the additional wagering opportunities offered by the liberalized doubling down and splitting rules. Further, by altering the deck, these modifications to the rules adjust the vigorish to a percentage which can be adjusted, preferably to levels comparable to standard Twenty-One.

The house will witness its patrons having more fun and an enjoyable time which will result in more drop and return business. At the same time, the house can feel comfortable knowing that professional card counters cannot obtain an advantage under this method of play. Further the vigorish can be adjusted to make sure the game is fair to players and yet provides a profit to the house.

It is an object of the present invention to provide a method for playing Twenty-one which will not only increase the player enjoyment of the game and provide for higher payouts to the player but also eliminate any advantage that a professional card counter may obtain by counting the cards during the play of conventional Twenty-One.

It is a feature of the present invention to use at least one deck of playing cards that comprise a standard 52 card with one or more player favorable cards of ten-count cards and/or Aces removed or one or more player unfavorable cards of 4'2, 5's, and/or 6's added to the deck. Various modifications are made to the rules of play of conventional Twenty-One to adjust for the fact that the deck has been modified to maintain a preselected vigorish.

It is an advantage of the present invention that new and more exciting casino games can be created which increase player activity and generate additional revenues to the house.

Other objects, features and advantages of the present invention will become apparent from a consideration of the following detailed description.

SUMMARY OF THE INVENTION

The standard deck of playing cards is modified by either or both adding one or more player unfavorable cards to or removing one or more player favorable cards from the deck. The alteration of the deck makes card counting much more difficult for the professional card player. In the preferred embodiment of the present invention, multiple decks of these forty-eight card decks having their ten-count cards removed may be used.

Because of the addition or removal of these cards, the odds of the game are shifted in favor of the house increasing the vigorish, the method of play is modified to provide liberal game rules and bonus payouts on the player's hand to re-adjust the vigorish. The result of these modifications to the method of play results in a vigorish which can be adjusted to be comparable to the of standard Twenty-one or less or greater than that of Twenty-One.

DESCRIPTION OF THE PREFERRED EMBODIMENTS

In the preferred embodiment of the present invention, a forty-eight card deck of cards comprising the Aces through the Nines and the Jacks, Queens and Kings (with the player favorable cards of the 10's removed) is used in the method of play. In the preferred embodiment of the present invention, multiple decks of these forty-eight card decks are shuffled together and used to deal the hands to the players and the dealer. Any number of these modified decks can be used, although the method of the present invention can be practiced using as few as a single deck of these forty-eight card decks. In a preferred embodiment of the present invention, a minimum of three decks should be used for full bonus payouts as described later herein.

The method of the present invention uses this modified deck of playing cards and the conventional manner of play of Twenty-One as modified with one or more of the following changes to the rules of standard Twenty-one. As in conventional Twenty-one, each player makes a wager to be eligible to participate in the game. Conventional dealing procedures are used which result in each player having two cards and the dealer having an up card and a down card.

Play proceeds as in the conventional manner of play of Twenty-One with each player determining whether to make an Insurance Bet, if appropriate; whether to split pairs, if appropriate; whether to Double Down or simply whether to stand or take hits to receive additional cards. Once all players have played their hands and have stood or busted, the dealer plays out his hand according to the conventional manner of play including the particular procedures of the gaming establishment relating to the hitting or staying of the dealer on hands of "soft 17." Once the dealer's final hand count is determined, winning wagers are paid and losing wagers are collected by the dealer.

Because the elimination of the four ten-spot cards from each conventional fifty-two card deck, the vigorish or mathematical odds of the game are shifted in favor of the house. This vigorish is commonly determined by computer simulation of the play of thousands or millions of hands. Armed with the rules of play and the payoffs, the computer can simulate perfect play by a player and calculate this vigorish. For standard Twenty-One there are numerous programs which can simulate play enabling players to test strategies. The vigorish for standard Twenty-One is typically agreed, for perfect play, to be approximately one percent.

Because the vigorish of standard Twenty-One would be altered in favor of the house by removal of the player favorable cards, the method of the present invention modifies the conventional manner of play of Twenty-One in order to move these mathematical odds closer to the mathematical odds that are present in conventional Twenty-One. These rule modifications can take various forms:

Form 1: Paying all Blackjacks. All player Blackjacks (a two card combination equally a numerical count of 21) are paid at three-to-two odds, including those occurring even if the dealer also has a Blackjack. Under the conventional manner of play of Twenty-One, the player's hand would be a push if both the player and the dealer had a Blackjack.

Form 2: Paying all 21's. The player's original bet is paid at one-to-one odds if the player's hand has a numerical count of 21 (non-Blackjack) even if the dealer also has a hand having a numerical count of 21. Under the conventional manner of play of Twenty-One, the player's hand would be a push if both the player and the dealer each had a hand having a numerical count of 21. Of course if, for example, the player's first two cards have a count of thirteen and the dealer has a Blackjack, the hand is over and the player loses since a dealer Blackjack prevents further player action on their hand.

Form 3: Double down anytime. A player is allowed to double down on any two or more cards. Under the conventional manner of play of Twenty-One, the player may only double down on his first two cards (and some gaming establishments only allow doubling down if the first two cards have a numerical count of 10 or 11). This doubling down would be permitted even after the player has split pairs, up to a maximum of four hands.

Form 4: Double down rescue. A player is allowed to rescue his double down wager (known as "Double Down Rescue"). After effecting a double down and receiving the third card, a player who is dissatisfied with his non-busted hand may take back (or rescue) the doubled portion of his wager, forfeit his original wager and concede his hand. This double down rescue option is not available to the player if the third card causes the player's numerical hand count to exceed 21.

Form 5: Bonus payouts are added to the method of play. If the player achieves any of the following card combinations during the play of his hand, he receives the associated bonus payout shown in Table 1:

TABLE 1

| Card Combination | Payout |
|---|---|
| Five card 21 | 3 to 2 |
| Six card 21 | 2 to 1 |
| Seven+ card 21 | 3 to 1 |
| 6-7-8 mixed suits | 3 to 2 |
| 6-7-8 same suit | 2 to 1 |
| 6-7-8 all Spades | 3 to 1 |
| 7-7-7 mixed suits | 3 to 2 |

TABLE 1-continued

| Card Combination | Payout |
|---|---|
| 7-7-7 same suit | 2 to 1 |
| 7-7-7 all Spades | 3 to 1 |

Form 6. Early surrender. Early surrender enables the player to surrender his first two card hand before the dealer having an Ace or ten-count up checks for a Blackjack and forfeit only half his original bet or ante.

Form 7. Re-doubling. Under a rule of re-doubling according to the present invention, when a player doubles down once, he may double down again by matching the amount he has at risk. For example, the dealer has a 5 showing and the player's first two cards are an Ace and a six for a soft seventeen. The player doubles down and receives a 3 for a total of 10 or 20. The player by matching the total of the wagers in action may double down again.

Form 8. Three Card Surrender. Under this modified rule a player may surrender after hitting his initial two card hand, now having three cards, and the hand does not exceed a numerical count of 21. (Under the standard rule of Twenty-one, the player may only surrender his two card hand. Once a player has commenced action, surrender is not permitted.)

Form 9. Dealer Ace Up Exposure. Under this player favorable rule, if the dealer has an up card as an Ace, the players are offered the option of taking insurance, the down card is turned over and exposed for the players to see. This action precedes the player's action. Hence the players know the dealers two card hand and can use this information in deciding to stand, take a hit or take further action. If the dealer has a Blackjack, all player hands are immediately resolved with no further player action.

An additional super bonus may also be added to the play of the game. Whenever a player receives three 7's of the same suit and the dealer's up card is also a 7, the player receives an additional bonus payout. In the preferred embodiment, this bonus payout would be $5,000 for a minimum bet of $25 and $1,000 for lower wagers. An "Envy Bonus" is also paid to the other players at the gaming table whenever a player wins this super bonus. In the preferred embodiment, the Envy Bonus would be $50 to each player.

The method of the present invention still includes the conventional manner of play of Twenty-One with regard to Insurance wagers being allowed and the dealer hitting any hand that has a numerical count of a soft 17.

While the invention has been illustrated with respect to several specific embodiments thereof, these embodiments should be considered as illustrative rather than limiting. Various modifications and additions may be made and will be apparent to those skilled in the art.

While the preferred embodiment of the method according to the present invention has been described above with reference to removal of 10's from the deck, the method also embraces alternative modifications to the standard game of Twenty-One. For example, consensus is that in a standard deck of cards, certain cards are player favorable while others are unfavorable. It is generally agreed that ten count cards (10's, Kings, Queens and Jacks) are player favorable cards inasmuch as an uneven distribution of these cards in a portion of a deck favors the player. Card counters consider the distribution of these cards to determine whether a deck portion or dealing shoe is positive, i.e. player favorable. Conversely 4's, 5's and 6's are generally considered player unfavorable cards. The remaining portion of a deck from which hands are to dealt which is statistically overloaded with these cards is unfavorable to the player. Other cards of the deck are generally considered neutral. By pre-loading the deck as originally dealt by removal or addition of player favorable and unfavorable cards, the advantage of the game, vigorish, can be tipped in favor of the house over standard Twenty-One. This type of deck modification is thought to frustrate card counters.

In addition to modification of the deck, according to the method of the present invention, one or more of the same modified rules of play described above can be provided to the players to, in cooperation with deck modification, provide a game having an adjustable vigorish. For example, three additional 6's could be added to a standard fifty-two card deck. Because these cards are player unfavorable, a computer simulation would show that the vigorish of this game would be higher than that of standard Twenty-One. To adjust the vigorish for the game back to that comparable to standard Twenty-One or to another vigorish, one or more of the above described rule modifications described above would be implemented. By selectively adding a rule change and running the simulation, the desired vigorish can be obtained.

It is to be understood that the deck modification can also be a combination of addition of player unfavorable cards and removal of player favorable cards, e.g. adding two 5's and taking out two Kings.

Further the cards added need not be of the same count. Two 6's and two 4's, for example, could be added to the deck.

By modifying the deck and providing the rules changes, card counting is frustrated. The additional variables introduced make card counting incompatible with the game.

The method of the present invention is not limited to live table game versions of Twenty-One. Any of the methods described above can be applied to a Twenty-One game that is programmed to operate on an electronic video gaming machine that displays Twenty-One to a player and the player effects the play of the game using control buttons or the like. Each of the features discussed above can be easily included in any electronic version of Twenty-One and the claims of the present invention are intended to include both the live table game version and the electronic video gaming machine version of the method of the present invention.

Accordingly, the invention should not be limited by the foregoing description, but rather should be defined only by the following claims.

What is claimed is:

1. A method for playing a modified game of Twenty-One having a preselected vigorish comprising:

(a) providing a deck of cards that is different from the standard deck of fifty-two cards in that the composition of the deck has at least one player favorable card removed from the deck or at least one player unfavorable card added to the deck in comparison with the standard deck of fifty-two cards;

(b) incorporating the following rule of play to standard Twenty-One in order to, in combination with step (a) obtain a desired vigorish, permitting in which the player doubles down after two cards are dealt to the player, and the player doubles down again after the player recieves an additional card and does not bust.

(c) the player making a wager to be eligible to play a hand;

(d) a dealer dealing two cards to the player and two cards to the dealer; and (e) the dealer and the player playing the game by standing or receiving more cards, and the dealer making a payoff for each winning hand and collecting each losing wager according to the standard rules of Twenty-One as altered by step (b).

2. The method of claim 1 wherein the providing step includes adding at least one player unfavorable card of a 4, 5 or 6 to the deck.

3. The method of claim 1 wherein the providing step includes removing at least one player favorable card of ten-count cards or an Ace from the deck.

4. The method of claim 1 wherein the deck is modified and the rules altered to obtain a vigorish substantially the same as standard Twenty-one.

5. The method of claim 1 wherein the incorporating step includes providing at least one of the following bonus payoff combinations

| Card Combination | Payout |
|---|---|
| Five card 21 | 3 to 2 |
| Six card 21 | 2 to 1 |
| Seven+ card 21 | 3 to 1 |
| 6-7-8 mixed suits | 3 to 2 |
| 6-7-8 same suit | 2 to 1 |
| 6-7-8 all Spades | 3 to 1 |
| 7-7-7 mixed suits | 3 to 2 |
| 7-7-7 same suit | 2 to 1 |
| 7-7-7 all Spades | 3 to 1 |

6. The method of claim 1 wherein the deck, in comparison with the standard deck of fifty-two cards, has a number of ten-count cards and/or Aces removed and in which said number of ten-count cards and/or Aces removed is no greater than one-half of the total number of ten-count cards and Aces in the standard deck of fifty-two cards.

7. A method for playing a modified game of Twenty-One having a preselected vigorish comprising:

(a) altering at least one of the following rules of play of standard Twenty-One:

(i) permitting early surrender, wherein the players have the option of surrendering their hands prior to the dealer checking the dealer's down card, (ii) permitting re-doubling, in which the dealer doubles down after two cards are dealt to the player, and the player doubles down again after the player receives an additional card and does not bust, (iii) permitting three card surrender, wherein a player can surrender after three cards are dealt to the player, (iv) permitting dealer Ace up exposure, wherein if the dealer's up card is an ace and after allowing for an insurance bet to be made, the dealer's down card is exposed before players decide to stand, take a hit or take further action (b) providing a deck that is different from the standard deck of fifty-two cards in that the composition of the deck has at least one player favorable card removed from the deck or at least one player unfavorable card added to the deck in comparison with the standard deck of fifty-two cards to obtain a preselected vigorish for the game;

(c) a player making a wager to be eligible to play a hand;

(d) a dealer dealing two cards to the player and two cards to the dealer one of the dealer's cards being face down; and (e) the dealer and player playing the game and the dealer making a payoff for each winning hand and collecting each losing wager according to the standard rules of Twenty-One as altered by step (a).

8. The method of claim 7 wherein the providing step includes adding at least one player unfavorable card of a 4, 5 or 6 to the deck.

9. The method of claim 7 wherein the providing step includes removing at least one player favorable card of ten-count cards or an Ace from the deck.

10. The method of claim 7 wherein the deck is modified and the rules altered to obtain a vigorish substantially the same as standard Twenty-One.

11. The method of claim 7 in which the providing step includes adding to the deck four player unfavorable cards.

12. The method of claim 11 in which the four cards are selected from 4's, 5's or 6's.

13. The method of claim 7 wherein the providing step includes removing from the deck four player favorable cards.

14. The method of claim 13 in which the four cards removed are selected from ten-count cards and Aces.

15. The method of claim 7 wherein the deck, in comparison with the standard deck of fifty-two cards, has a number of ten-count cards and/or Aces removed and in which said number of ten-count cards and/or Aces removed is no greater than one-half of the total number of ten-count cards and Aces in the standard deck of fifty two cards.

16. A method for playing a modified game of Twenty-One having a preselected vigorish comprising:

providing a deck of cards that is different from the standard deck of fifty-two cards in that, in comparison with the standard deck of fifty-two cards, the deck has a number of ten-count cards and/or Aces removed and in which said number of ten-count cards and/or Aces removed is not greater than one-half of the total number of ten-count cards and Aces in the standard deck of fifty-two cards;

incorporating at least one of the following rules of play to standard Twenty-One in order to, in combination with said providing step, obtain a desired vigorish:

(i) paying all players that have blackjacks, even if the dealer has blackjack, (ii) paying all players that have 21s, even if the dealer has 21 , (iii) permitting players to double down at any time, (iv) permitting double down rescue, wherein players may take back the double down portion of their wager, (v) adding a schedule or bonus payoff combinations, (vi) early permitting surrender, wherein the players have the option of surrendering their hands prior to the dealer checking the dealer's down card, (vii) permitting re-doubling in which the player doubles down after two cards are dealt to the player, and the player doubles down again after the player receives an additional card and does not bust (viii) permitting three card surrender, wherein a player can surrender after three cards are dealt to the player, and (ix) permitting dealer ace up exposure; wherein if the dealer's up card is an ace and after allowing for an insurance bet to be made, the dealer's down card is exposed before players decide to stand, take a hit or take futher action the player making a wager to be eligible to play a hand;

a dealer dealing two cards to the player and two cards to the dealer, one of the dealer's cards being face down; and the dealer and the player playing the game by standing, taking a hit or taking further action as permitted by the rules above and the dealer making a payoff for each winning hand and collecting each losing wager according to the standard rules of Twenty-One as altered by said incorporating step.

17. The method of claim 16 wherein four ten-count cards are removed.

18. The method of claim 16 wherein the providing step includes adding at least one player unfavorable card of a four, a five or six to the deck.

19. A method for playing a modified game of Twenty-One having a preselected vigorish comprising:

providing a deck of cards that is different from the standard deck of fifty-two cards in that, in comparison with the standard deck of fifty-two cards, the composition of the deck has at least one player unfavorable card added to the deck and in which, when one or more ten-count cards and/or Aces are removed, the number removed is no greater than one-half of the total number of ten-count cards and Aces in the standard deck of fifty-two cards;

incorporating at least one of the following rules of play to standard Twenty-One in order to, in combination with said providing step, obtain a desired vigorish:

(i) paying all players that have blackjacks, even if the dealer has blackjack, (ii) paying all players that have 21s, even if the dealer has 21, (iii) permitting players to double down at any time, (iv) permitting double down rescue, wherein players may take back the double down portion of their wager, (v) adding a schedule or bonus payoff combinations, (vi) permitting early surrender, wherein the players have the option of surrending their hands prior to the dealer checking the dealer's down card, (vii) permitting re-doubling in which the player doubles down after two cards are dealt to the player, and the player doubles down again after the player receives an additional card and does not bust.

(viii) permitting three card surrender, wherein a player can surrender after three cards are dealt to the player, and (ix) permitting dealer ace up exposure wherein if the dealer's up card is an ace and after allowing for an insurance bet to be made, the dealer's down card is exposed before players decide to stand, take a hit or take further action;

the player making a wager to be eligible to play a hand;

a dealer dealing two cards to the player and two cards to the dealer, one of the dealer's cards being face down; and the dealer and the player playing the game by standing, taking a hit or taking further action as permitted by the rules above and the dealer making a payoff for each winning hand and collecting each losing wager according to the standard rules of Twenty-One as altered by said providing step.

20. The method of claim 19 wherein the deck, in comparison with the standard deck of fifty-two cards, has at least one of a ten-count card and an Ace removed.

21. The method of claim 19 wherein four ten-count cards are removed.

* * * * *